US005094893A

United States Patent [19]

Snider

[11] Patent Number: 5,094,893

[45] Date of Patent: Mar. 10, 1992

[54] ARTIFICIAL CHRISTMAS TREE

[76] Inventor: Don Snider, 39320 South Ave., Zephyrhills, Fla. 33540

[21] Appl. No.: 647,437

[22] Filed: Jan. 29, 1991

[51] Int. Cl.[5] ..... A47G 33/06

[52] U.S. Cl. ..... 428/18; 211/205; 428/20

[58] Field of Search ..... 428/18, 19, 20; 211/196, 205; 362/123

[56] References Cited

U.S. PATENT DOCUMENTS

| | | | |
|---|---|---|---|
| 3,704,366 | 11/1972 | Korb et al. | 428/18 X |
| 4,278,481 | 7/1981 | Osment | 428/18 X |
| 4,620,270 | 10/1986 | Laakso | 362/123 |
| 4,968,541 | 11/1990 | McCrory | 428/20 X |

*Primary Examiner*—Henry F. Epstein
*Attorney, Agent, or Firm*—Brooks & Kushman

[57] ABSTRACT

An artificial Christmas tree (10) which simulates a decorated real Christmas tree is disclosed comprising a base stake (26) for insertion in the ground, an upstanding trunk (12) having an enlarged diameter lower trunk portion (24) connected at the bottom to the stake (26) and terminating at its upper end in a smaller diameter upper trunk portion (30), a hoop (14) encircling the trunk (12) at the upper end of the enlarged diameter lower trunk portion (24), angularly spaced-apart spokes (16) connected between the hoop (14) and trunk (12) for holding them in concentric relation, upper guys (18) extending between the hoop (14) and the upper trunk portion (30), and lower guys (22) for connection between the hoop (14) and the ground to stabilize the hoop (14) and trunk (12). Intermediate guys (20) are connected between the hoop (14) and a point of the trunk (12) substantially midway between the spokes (16) and the top of the trunk. An omnidirectional star (50) having three half-star-shaped sections (52) arranged at 120° intervals is attached to the top of the tree (10), and presents a full star shape when viewed from any angle. Light strings (94) are looped between the hoop (14) and top of the trunk adjacent each of the upper guys (18), and garland is spirally wrapped around the tree from the top of the trunk to the hoop, and may also be draped as desired. At night, the illuminated tree appears to sparkle giving a jewel-like appearance. The artificial Christmas tree (10) is suitable for outdoor use, and the trunk (12) extends from the lowest simulated limbs of the tree (10) to the ground. The lower trunk (24) may be wrapped with a light string.

13 Claims, 3 Drawing Sheets

ARTIFICIAL CHRISTMAS TREE

TECHNICAL FIELD

This invention relates to artificial Christmas trees.

BACKGROUND ART

To avoid the time and effort necessary to obtain, decorate, and dispose of a real Christmas tree, artificial Christmas trees which simulate the appearance of decorated evergreen trees have become popular. A problem with many of these simulated trees, particularly those adapted for outdoor use, is that they are difficult to stabilize. Many designs, in fact, are intended to be placed over real trees. One approach to this problem is suggested in U.S. Pat. No. 3,704,366 to Korb et al., issued Nov. 28, 1972, which discloses a plurality of downwardly projecting support legs which are fastened to a base or the ground. Multiple legs, however, do not accurately simulate a tree trunk. U.S. Pat. No. 4,620,270 to Laakso, issued Oct. 28, 1986, discloses a simulated tree which does have a central trunk. This design, however, teaches the use of a ring shaped base which is adapted to be secured on the floor or ground, and thus the trunk does not appear to a viewer to extend from the lowest part of the body of the tree to the ground. Further problems with conventional artificial Christmas tree are that they frequently are not variable in height, they often lack a traditional star, and the various sections from which the tree is constructed are not readily available or inexpensive.

SUMMARY OF THE INVENTION

It would be desirable to have an artificial Christmas tree which is stable when used outdoors, has a central trunk which depends from the lowest simulated limbs of the tree, is variable in height, has a star atop it, and which can be constructed from inexpensive components. Therefore, the present invention provides a novel artificial Christmas tree which comprises a tree structure, that may be fabricated, for most part, of relatively inexpensive, lightweight, readily available parts, which is stable even in adverse weather conditions, and may be readily decorated with hundreds of lights, garland and the like to provide a jewel-like nighttime appearance, and an attractive daytime exhibit. The tree comprises a base stake for insertion in the ground, an upstanding trunk having an enlarged diameter lower trunk portion connected at the bottom to the stake and terminating at its upper end in a smaller diameter upper trunk portion, a hoop encircling the trunk at the upper end of the enlarged diameter lower trunk portion, angularly spaced apart spokes connected between the hoop and trunk for holding them in concentric relation guys extend between the hoop and the upper trunk, and between the hoop and the ground to stabilize the hoop and trunk. Upon this structure, light strings extend between the hoop and top of the trunk and around the trunk beneath the hoop. Garland strings encircle the structure and may be attached thereto by spring clamps. An omnidirectional star having three half-star-shaped sections arranged at 120° intervals is removably attached to the upper trunk portion.

Accordingly, it is an object of the present invention to provide an artificial Christmas tree of the type described above which has a central trunk which realistically simulates the trunk of an actual tree, and is sufficiently stable for outdoor use without the need to be supported by a real tree.

Another object of the present invention is to provide an artificial Christmas tree of the type described above which is easily assembled for the most part from standard, commercially available components.

Still another object of the present invention is to provide an artificial Christmas tree of the type described above which may be varied in height.

Still another object of the present invention is to provide an artificial Christmas tree of the type described above which has a star on top which presents a realistic appearance when viewed from any direction.

These and other objects, features and advantages of the present invention will be more apparent from the following description and drawings.

BEST MODE FOR CARRYING OUT THE INVENTION

Figure 1:
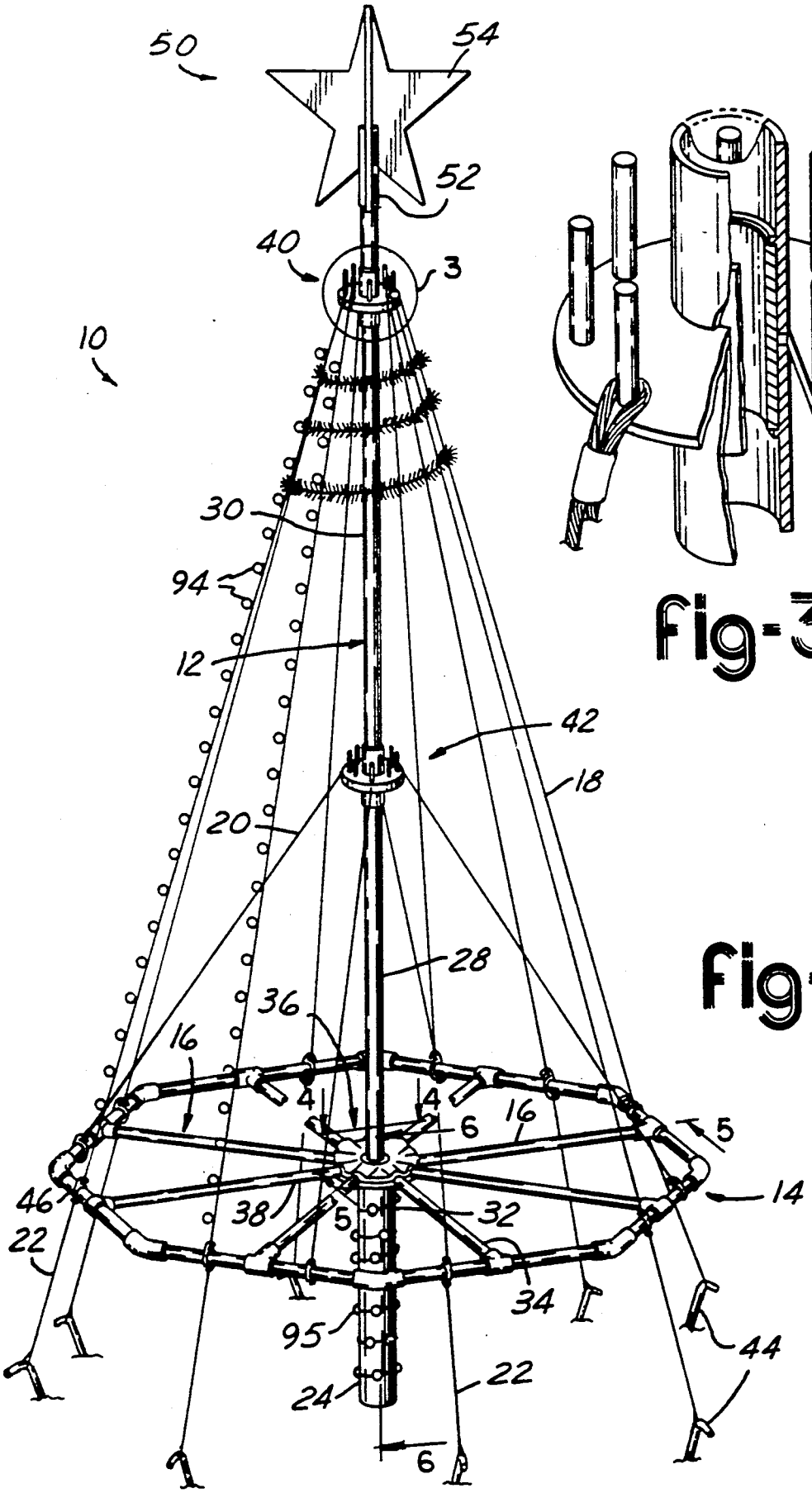
FIG. 1 is a perspective view of an artificial Christmas tree according to the present invention showing the basic tree structure with guys, some light strings and some garland.

With reference to the drawings, the preferred embodiments of the present invention will be described. Referring to FIG. 1, there is shown a partially decorated artificial Christmas tree 10 generally comprising an upstanding central trunk 12, a hoop 14, angularly spaced apart spokes 16, first or upper guys or strings 18, second or intermediate guys or strings 20, and third or lower guys or strings 22.

Figure 6:
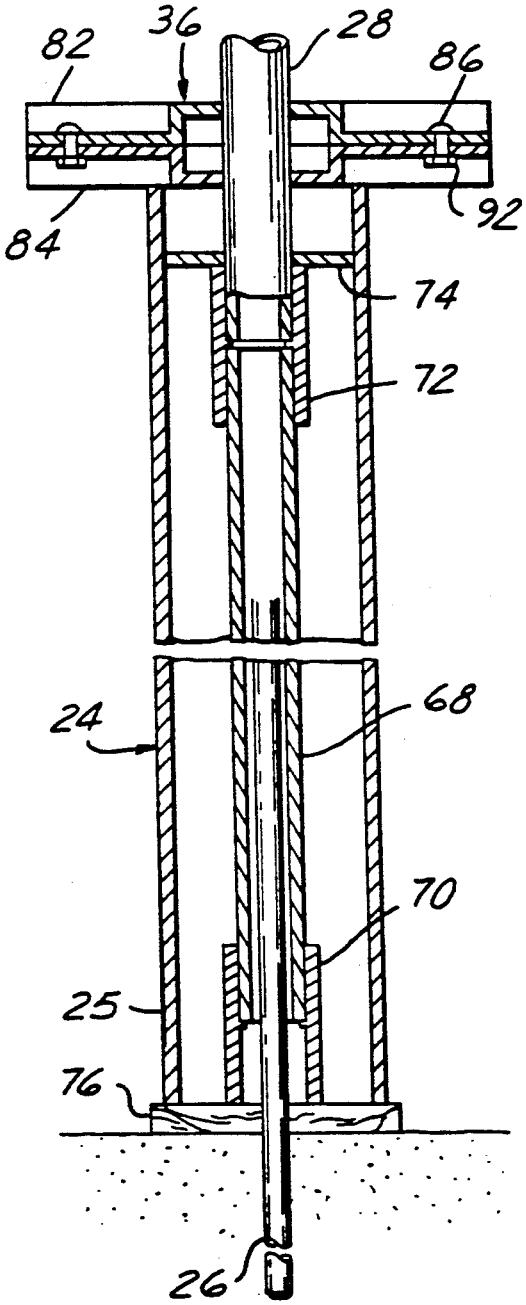
FIG. 6 is a cross-sectional view of a lower trunk portion of the artificial Christmas tree taken along line 6—6 in FIG. 1.

The trunk 12 stands generally upright but is relatively flexible, and has an enlarged diameter lower trunk portion 24 connected at the bottom 25 to a base stake 26, as shown in FIG. 6. The trunk 12 also includes a middle trunk portion 28 and terminates at its top or upper end in upper trunk portion 30. Both middle and upper trunk portions 28 and 30 are about forty inches long (though they can be of greater or shorter lengths as desired) and smaller in diameter than lower trunk portion 24, and like other sections of the present invention, can be constructed from commercially available polyvinyl chloride (PVC) components. For the lower trunk portion 24, three and one-half inch diameter PVC plastic pipe about two feet in length is preferred.

The hoop 14 is spaced above the ground and encircles the trunk 12 at the upper end 32 of the lower trunk portion 24. The hoop 14 is relatively more rigid in construction than the trunk 12, and is removably connected to the radially spaced outer ends 34 of the spokes 16. An annular hub 36 (shown in FIG. 7) positioned upon the lower trunk portion 24 encircles the trunk 12, and is removably connected to the inner ends 38 of the spokes 16. The hub 36 thus keeps the hoop 14 and the trunk 12 in concentric relation.

The first or upper guys 18 extend between the hoop 14 and a top knot 40 on the top end of upper trunk portion 30. The first guys 18 are angularly spaced apart around the trunk 12, and support the hoop 14 off the ground. The first guys 18 may be lightweight cables intended to support the hoop 14, and stabilize the upper end of the trunk. Preferably eight such guys are used.

The second or intermediate guys 20 are connected between the hoop 14 and a middle knot 42 which is located substantially midway between the spokes 16 and the top end of the upper trunk portion 30. The second guys 20 are also angularly spaced apart, but at points angularly intermediate the first guys 18. The second guys 20 are also light-weight cables similar to first guys 18. Four guys 20 are used. Decorative light strings (94) are looped between S-hooks (46) and the top knot (40) and are wrapped as at (95) around the trunk portion (32). Additional decorations in the form of garlands (96) are wound around the cone defined by the first guys 18 and the hoop 14, from the top knot (40) to the hoop. The garland strings are readily commercially available. They may be attached to the guys by small plastic clothespins and give the tree an appearance of fullness. It is to be understood that not all the light strings or garland is shown because such would obscure the tree structure in FIG. 1. Some garland may be also draped on the tree in depending loops, or criss-crossed or otherwise hung as desired. The objective is to completely cover and conceal the underlying tree structure.

The third or lower guys 22 are wires or cables connected to the same S-hooks 46 to which the lower ends of ugys 18 are connected, and are adapted to be connected to spaced apart anchoring stakes 44 embedded in the ground. The third guys 22 are not lighted, so that the lower trunk portion 24 appears to depend from the lowest limbs of the tree 10 to the ground. The first, second, and third guys 18, 20, and 22 are connected to hoop 14 by "S" hooks 46. Preferably, eight such lower guys 22 are used. The third guys 22 function to tie down the artificial Christmas tree 10 and by attaching them to the same S-hooks as the upper guys 18, balanced forces are put on the hoop 14. As a result of the structure of the tree 10, it is stable enough for use outdoors without being supported by a real tree, while the relative flexibility of the trunk portions 28 and 30 allow it to bend in the wind.

An omnidirectional star 50 is removably attached to a stub 52 connected to upper trunk portion 30 above the top knot 40. The star 50 has three half-star-shaped sections 54 extending at 120° intervals from the stub 52. Thus, a full star shape is visible when the tree 10 is viewed from any direction.

Figure 2:
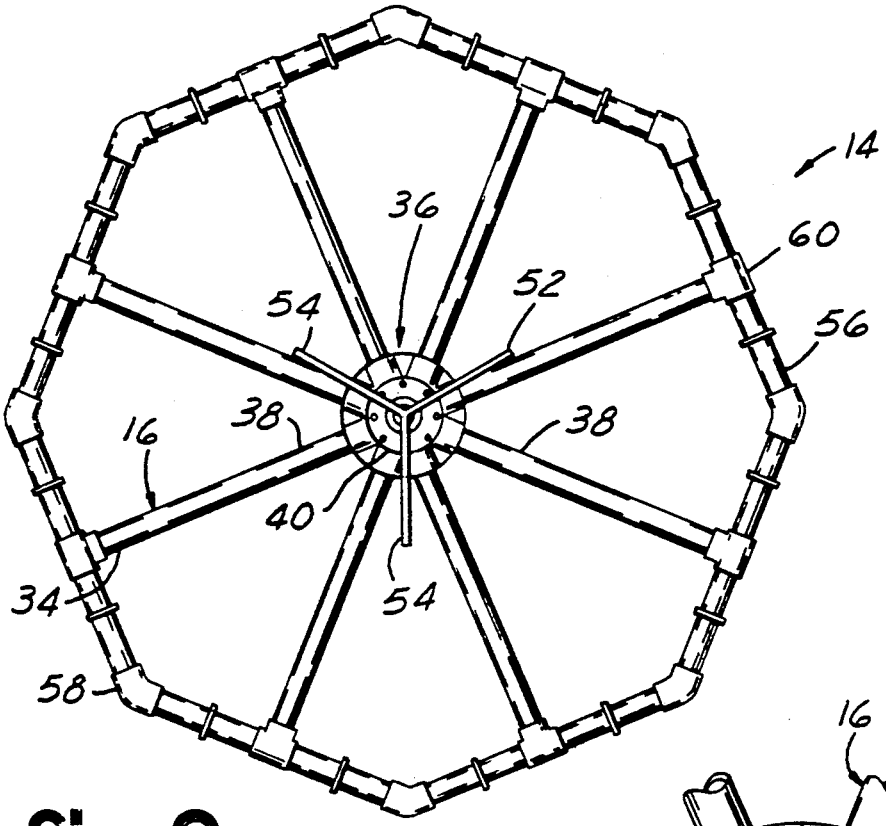
FIG. 2 is a plan view of a hoop and angularly spaced apart spokes of the artificial Christmas tree.

FIG. 2 shows the hoop 14, including hoop sections 56 which extend between the outer ends 34 of adjacent spokes 16. Although it is possible to have hoop sections which extend directly between the outer ends 34 of the spokes 16, a preferred embodiment of the artificial Christmas tree 10 has eight hoop sections 56 joined by elbow joints 58. "T" joints 60 join the hoop sections 56 to the spokes 16, connecting the generally octagonal hoop 14 to the trunk 12. For the hoop sections 56, spokes 16, and trunk portions 28 and 30, three-quarter inch diameter PVC pipe can be used. Joints 58 and 60 are commercially available pipe joints of sufficient diameter to snugly receive the hoop sections 56 without need for gluing or cementing them in place.

Figure 3:
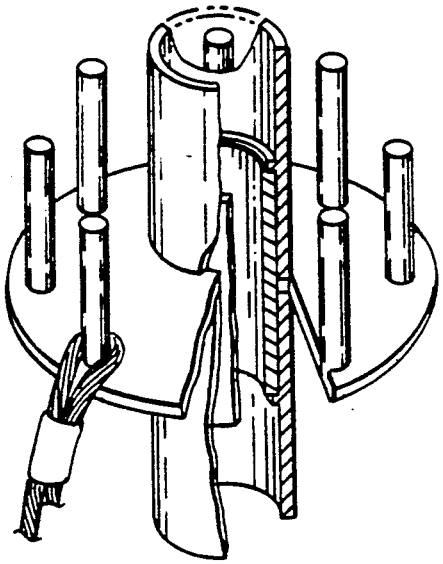
FIG. 3 is a perspective view of a trunk and middle knot of the artificial Christmas tree.

Referring now to FIGS. 1 and 3, there is shown middle knot 42. Middle trunk portion 28 extends up from the hub 36 and is telescoped into a lower extension or coupler 62 of middle knot 42, and upper trunk portion 30 extends down from top knot 40 and telescopes into an upper extension or coupler 64 of the middle knot 42. A sleeve (31) received in the adjacent ends of couples (62) and (64) serve to integrate them on opposite sides of the annular plate 33 which is slipped over the sleeve. A plurality of posts 35, integral with plate 33 and angularly spaced therearound, serve to receive the looped ends of the guys 20. The extensions 62 and 64 are integral with the middle knot 42. In a preferred embodiment, four second guys 20 are installed at 90 intervals on posts 35 of middle knot 42, and depend to the "S" hooks 46 on the hoop 14. Top knot 40 has substantially the same construction as middle knot 42, with four first guys 18 installed at 90° intervals angularly offset from second guys 20 over posts similar to middle knot posts 35.

Figure 4:
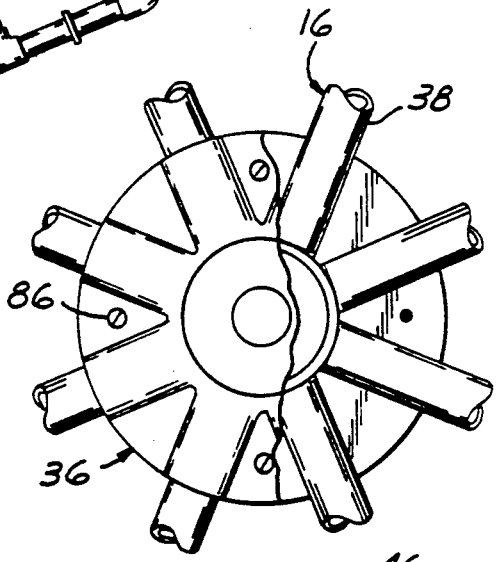
FIG. 4 is a plan view of a hub of the artificial Christmas tree taken along line 4—4 in FIG. 1.
Figure 5:
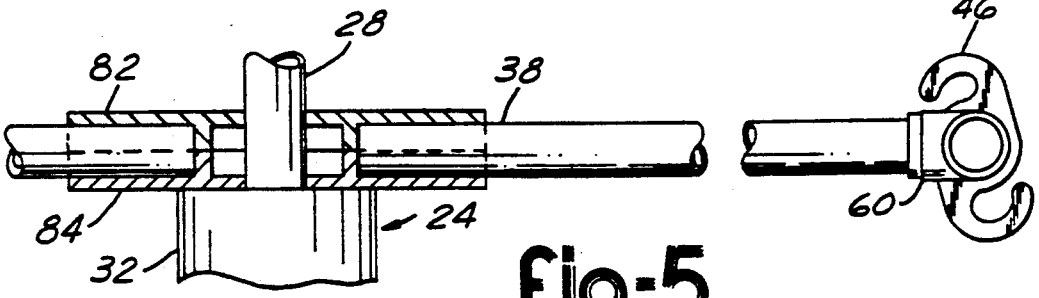
FIG. 5 is a partial cross-sectional view of the hub and spokes taken along line 5—5 in FIG. 1.

FIGS. 4 and 5 show annular hub 36 receiving the inner ends 38 of the spokes 16. As described above, the hub 36 encircles the trunk 12 at the upper end of the enlarged diameter lower trunk portion 24. The hub 36 rests upon the upper end 32 of the lower trunk portion 24, and middle trunk portion 28 rises through the center of the hub 36. As shown in cross-section in FIG. 5, the spokes 16 radiate outwardly from the hub 36 to the "T" joints 60.

Referring now to FIG. 6, the middle trunk portion 28 extends downwardly through the lower trunk portion 24, and is connected to the base stake 26 as follows. Inner support pipe 68 including integral coupler 70 slides in place over stake 26. Middle trunk portion 28 likewise has a downwardly extending coupler 72 attached to its bottom end which telescopes over the pipe 68 and the stake 26. A spacer 74 rests on top of the downward extension 72 and extends between the downward extension 72 and the lower trunk portion 24 to maintain them in concentric relation. Thus, the lower trunk portion 24 telescopes over the downward extension 72 and base stake 26, and rests on a plywood block 76 provided as a foundation. The couplers 70 and 72 are standard plastic pipe fittings, while the spacer 74 is a three and one-sixteenth inch diameter washer.

The overall height of the tree 10 is easily varied. If one wishes to decrease the height, then middle trunk portion 28, middle knot 42, and second guys 20 can be removed. In that case, upper trunk portion 30 can be equipped with a downward extension similar to coupler 72 which will telescope over the stake 26, and the enlarged diameter lower trunk portion 24 will telescope over the downward extension of upper trunk portion 30. If one wishes to increase the height of tree 10, additional sections similar to upper trunk portion 30 can be added, along with stabilizing means such as knots and guys.

Figure 7:
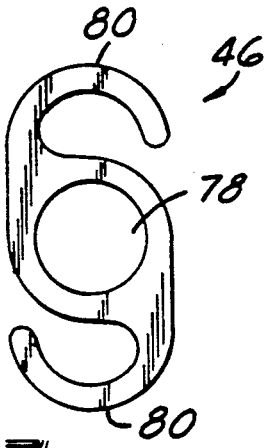
FIG. 7 is a plan view of an "S" hook of the artificial Christmas tree.

FIG. 7 shows the "S" hook 46 which connects guys 18, 20, and 22 to the hoop 14. Center hole 78 has a diameter slightly greater than hoop sections 56, and thus the "S" hooks 46 can rotate around the hoop sections 56. This allows the curved ends 80 to be oriented in response to tensions exerted by guys 18, 20, and 22.

Figure 8:
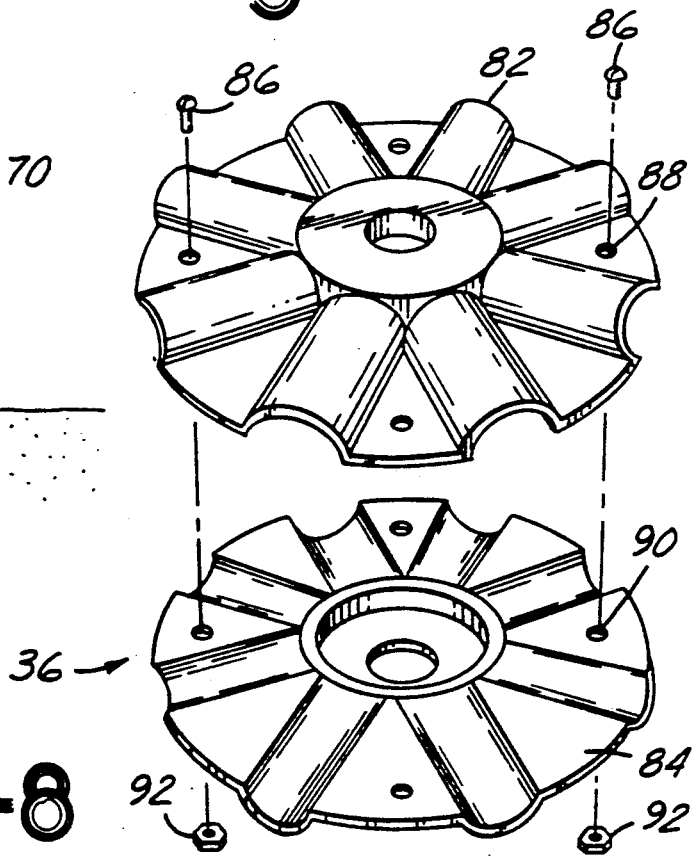
FIG. 8 is a perspective view of opposed upper and lower annular sections of the hub.

Referring now to FIG. 8, there is shown complimentary opposed upper and lower annular hub sections 82 and 84 which comprise the annular hub 36.

Means for clamping the hub sections 82 and 84 together, such as bolts 86, are placed through holes 88 and 90 in the upper and lower annular sections 82 and 84, respectively, and are secured by nuts 92. When so secured, the sections 82 and 84 provide clamping engagement on the spokes 16 at the trunk 12.

The artificial Christmas tree 10 is assembled as follows. First, the base stake 26, preferrably a one-half inch diameter metal stake about twenty-eight inches long, is driven into the ground at the desired site, and block 80 is placed over the base stake 26. Next, inner support pipe 68 including integral coupler 70 is placed over the base stake 26. Then the coupler 72 of middle trunk portion 28 is placed over pipe 68, and spacer 74 is placed over middle trunk portion 28 until it rests on the coupler 72. The lower trunk portion 24 is next lowered over the middle trunk portion 28, pipe 68, and spacer 74, until it rest on block 76. The assembled hub 36 is then slid over the top of middle trunk portion 28 until it rests on the lower trunk portion 24, and the middle knot 42 is installed on the upper end of middle trunk portion 28. Next, one end of upper trunk portion 30 is inserted into the top knot 40, and then the other end is placed into the middle knot 42. Any additional height-extending trunk portions and knots can then be installed, and guys attached between hooks of the knots and "S" hooks 46 on the hoop 14. Next, third guys 22 are run from the "S" hooks 46 to the stakes 44 in the ground. Finally, the star 50 and stub 52 are attached to the uppermost trunk portion. Next the light strings are strung between the top knot and hoop, and decorations such as garlands are wrapped about the cone-like structure and secured by small plastic clothespins (not shown). Additional garland strings may be draped on the tree as desired. A light string 95 is also wrapped about the larger diameter trunk 24 (preferably before the hoop is installed).

It should be understood, of course, that while the forms of the invention herein shown and described constitute preferred embodiments of the invention, they are not intended to illustrate all possible forms thereof. It should also be understood that the words used are words of description rather than limitation and various changes may be made without departing from the spirit and scope of the invention disclosed.

What is claimed is:

1. An artificial Christmas tree comprising, in combination:

a base stake for insertion in the ground;

an upstanding trunk having an enlarged diameter lower trunk portion connected at the bottom to the stake and terminating at its upper end in a smaller diameter upper trunk portion;

a relatively rigid hoop encircling the trunk at the upper end of the enlarged diameter lower trunk portion;

angularly spaced apart spokes connected between the hoop and trunk for holding them in concentric relation;

strings extending between the hoop and the upper trunk portion at least some of which are decorative;

strings extending between the hoop and the ground to stabilize the hoop and trunk; and at least some of said strings connected to the hoop intermediate the spokes.

2. The invention defined by claim 1 wherein said smaller diameter upper trunk portion extends downwardly through said enlarged diameter lower trunk portion and is connected to said stake.

3. The invention defined by claim 1 wherein a hub encircles said upstanding trunk at the upper end of said enlarged diameter lower trunk portion, and said spokes ar connected to said hub.

4. The invention defined by claim 1 wherein said smaller diameter upper trunk portion has a downward extension telescoped over said stake; said enlarged diameter lower trunk portion telescoped over said downward extension; spacer means between said downward extension and said lower trunk portion maintaining the same in concentric relation; a hub member telescoped over said smaller diameter upper trunk portion and resting on said lower trunk portion; and said spokes connected to said hub.

5. The invention defined by claim 1 wherein the smaller diameter upper trunk portion is relatively flexible and some of said strings are connected between the hoop and the top of the trunk and others are connected between the hoop and a point of the trunk substantially midway between the spokes and the top of the trunk.

6. A structural frame for an artificial Christmas tree comprising, in combination:

an upstanding but relatively flexible trunk having a bottom end to rest on the ground and a top end spaced thereabove;

a relatively more rigid hoop encircling the trunk adjacent the bottom end but spaced thereabove;

a plurality of angularly spaced apart spokes connected between the trunk and hoop; and a plurality of first guys connected between the hoop and top of the trunk in angularly spaced apart relation therearound, a plurality of second guys connected between the hoop and a point of the trunk substantially midway between the spokes and the top of the trunk and angularly intermediate the first guys, and a plurality of third guys connected to the hoop adjacent the first and second guys and adapted to be connected to the ground for stabilizing the tree.

7. An artificial Christmas tree comprising:

a base stake adapted to be inserted into the ground;

a central trunk having a lower portion connected to the base stake and also having an upper portion;

an annular hub positioned upon the lower portion of the trunk spaced above the ground;

a plurality of spokes having inner ends removably connected to the annular hub and outer ends radially spaced from the annular hub;

a relatively rigid hoop removably attached to the outer ends of the spokes;

decorative strings connected to the upper portion of the trunk and extending radially downwardly and connected to the hoop; and guys connected to the hoop and to the ground to stabilize the hoop and trunk.

8. The artificial Christmas tree of claim 7 further comprising an omnidirectional star removably attached to the upper portion of the trunk, the star having three half-star-shaped sections arranged at 120° intervals.

9. The artificial Christmas tree of claim 7 further comprising "S" hooks attached to the hoop for attaching the decorative strings to the hoop.

10. The artificial Christmas tree of claim 9 further comprising a plurality of spaced apart anchoring stakes and means for tying down the tree to the "S" hooks.

11. The artificial Christmas tree of claim 7 wherein the hoop comprises a plurality of sections, each section extending between the outer ends of adjacent spokes.

12. The artificial Christmas tree of claim 11 wherein the hoop is generally octagonal in shape.

13. The artificial Christmas tree of claim 7 wherein the hub comprises complimentary opposed upper and lower annular sections for clamping engagement on the spokes at the trunk, and means for clamping the hub sections together.

* * * * *